US007874035B2

(12) United States Patent
Park et al.

(10) Patent No.: US 7,874,035 B2
(45) Date of Patent: Jan. 25, 2011

(54) APPARATUS FOR CONNECTING A PRECAST DECK SLAB WITH A BEAM ON A BRIDGE AND METHOD FOR CONNECTING THE SLAB WITH THE BEAM USING THE SAME

(75) Inventors: Sun-Kyu Park, Seoul (KR); Sung-Oh Kim, Gyeonggi-do (KR); Sung-Nam Hong, Gyeonggi-do (KR); Tae-Wan Kim, Seoul (KR); Kyoung Bong Han, Gyeonggi-do (KR)

(73) Assignee: Sungkyunkwan University Foundation for Corporated Collaboration, Gyeonggi-Do (KR)

( * ) Notice: Subject to any disclaimer, the term of this patent is extended or adjusted under 35 U.S.C. 154(b) by 0 days.

(21) Appl. No.: 12/297,981

(22) PCT Filed: Oct. 15, 2007

(86) PCT No.: PCT/KR2007/005030

§ 371 (c)(1),
(2), (4) Date: Oct. 21, 2008

(87) PCT Pub. No.: WO2008/062949

PCT Pub. Date: May 29, 2008

(65) Prior Publication Data

US 2009/0277124 A1 Nov. 12, 2009

(30) Foreign Application Priority Data

Nov. 22, 2006 (KR) ..... 10-2006-0115853

(51) Int. Cl.
*E01D 19/12* (2006.01)

(52) U.S. Cl. ..... 14/73; 14/14; 14/74.5; 14/77.1; 14/78; 403/408.1; 404/34; 404/36; 404/43; 404/71; 411/82

(58) Field of Classification Search ..... 404/17, 404/18, 34–36, 70, 71, 43; 14/70, 73, 74.5, 14/77.1, 78, 14; 411/82; 403/408.1
See application file for complete search history.

(56) References Cited

U.S. PATENT DOCUMENTS 1,167,615 A * 1/1916 Barnes ..... 404/136

(Continued)

FOREIGN PATENT DOCUMENTS

JP 09302673 11/1997

(Continued)

*Primary Examiner*—Raymond W Addie
(74) *Attorney, Agent, or Firm*—Kinney & Lange, P.A.

(57) ABSTRACT

Provided are a connection apparatus and a connection method capable of rapidly and fixing a pre-cast deck slab with a beam. The connection apparatus includes a main body buried in the pre-cast deck slab and having a hollow part formed in an axial direction thereof! a plurality of support portions integrally formed with an outer surface of the main body, each of which has a body having a certain length and a hook integrally formed with an end of the body; a bolt having a bolt body inserted into the hollow part of the main body and a fixing hole of the beam, and a head integrally formed with an upper end of the bolt body! and a nut threadedly engaged with the bolt body of the bolt.

7 Claims, 9 Drawing Sheets

U.S. PATENT DOCUMENTS

| | | | | | |
|---|---|---|---|---|---|
| 1,288,177 | A * | 12/1918 | Pleister | 411/80.6 |
| 1,734,994 | A * | 11/1929 | Bowers | 404/136 |
| 1,768,246 | A * | 6/1930 | Gaddis | 52/708 |
| 3,217,615 | A * | 11/1965 | Crone | 404/74 |
| 3,579,942 | A * | 5/1971 | Cole | 52/787.12 |
| 3,870,428 | A * | 3/1975 | Jackson | 404/134 |
| 5,957,644 | A * | 9/1999 | Vaughan | 411/82 |
| 6,102,614 | A * | 8/2000 | Yukawa | 404/35 |
| 6,317,915 | B1 * | 11/2001 | Grearson | 14/73 |
| 6,588,160 | B1 * | 7/2003 | Grossman | 52/223.7 |
| 6,904,636 | B2 * | 6/2005 | Hwang et al. | 14/73 |
| 7,003,837 | B2 * | 2/2006 | Pollard et al. | 14/73 |
| 7,600,283 | B2 * | 10/2009 | Nelson | 14/77.1 |
| 2006/0117504 | A1 * | 6/2006 | Ronald et al. | 14/73 |
| 2007/0000077 | A1 * | 1/2007 | Wilson | 14/73 |
| 2007/0180634 | A1 * | 8/2007 | Grace | 14/73 |

FOREIGN PATENT DOCUMENTS

| | | |
|---|---|---|
| JP | 2002235403 | 8/2002 |
| KR | 1020030064362 A | 7/2003 |

* cited by examiner

【Figure 1】
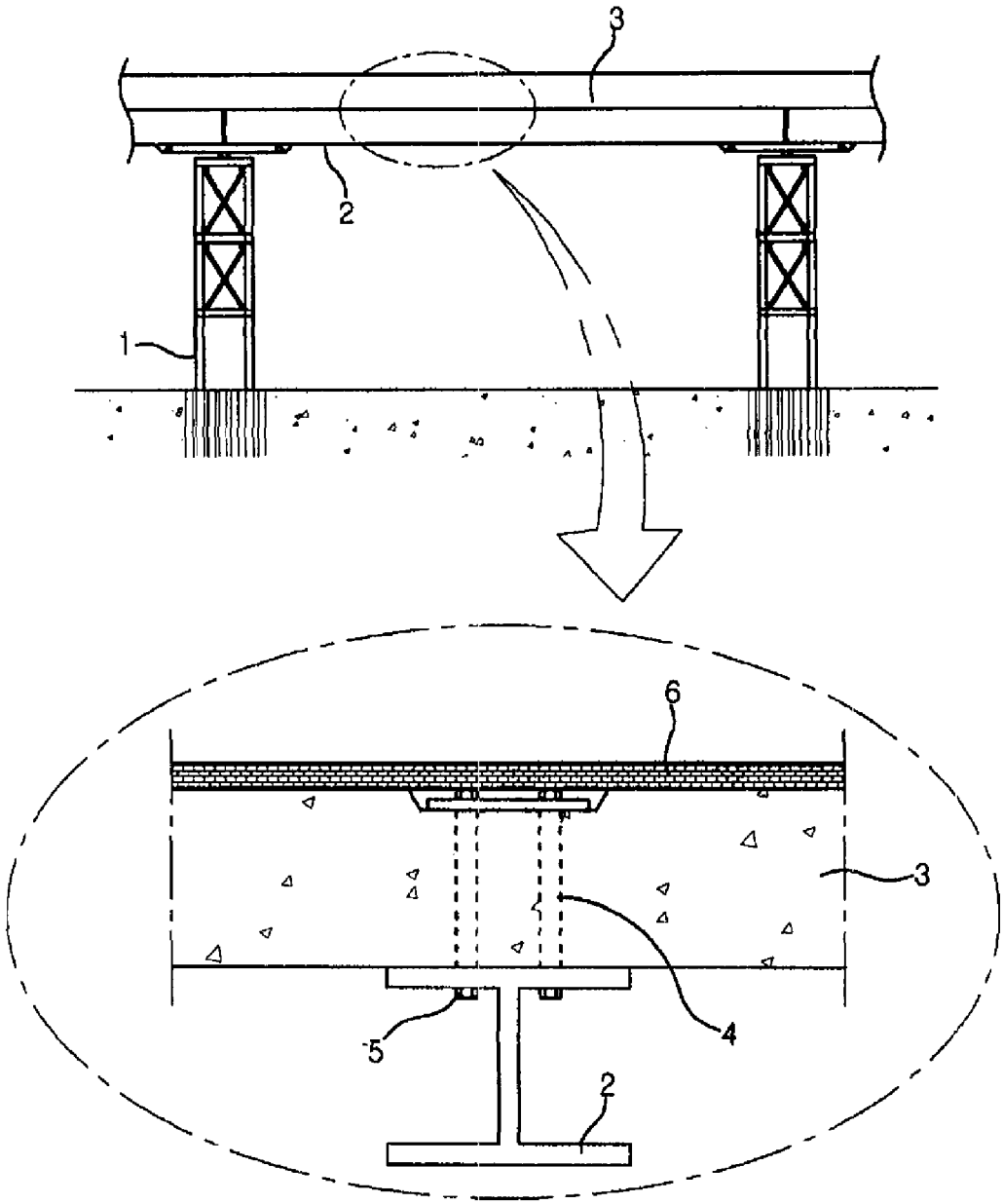

【Figure 2】
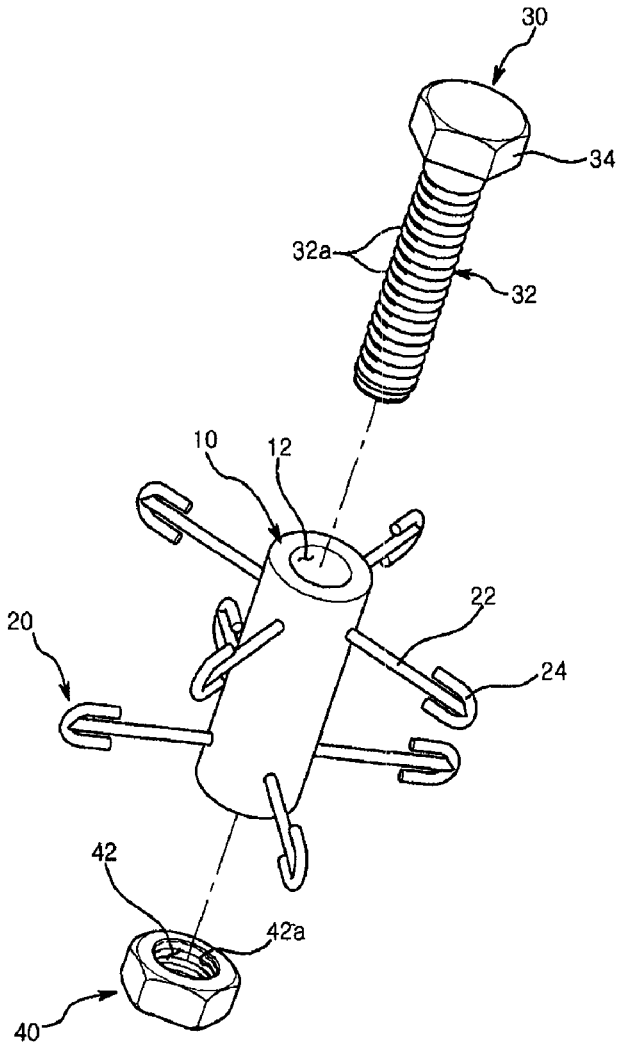
【Figure 3】
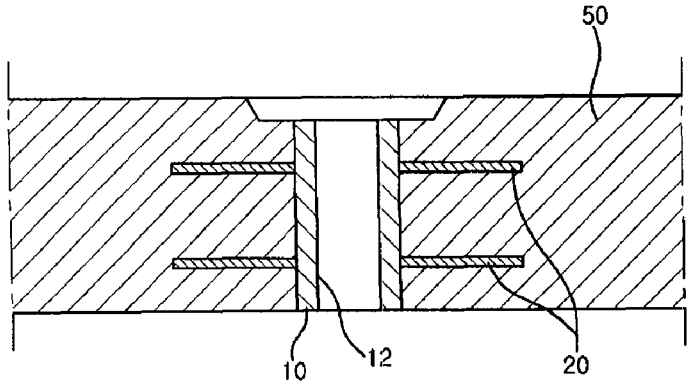

【Figure 4】
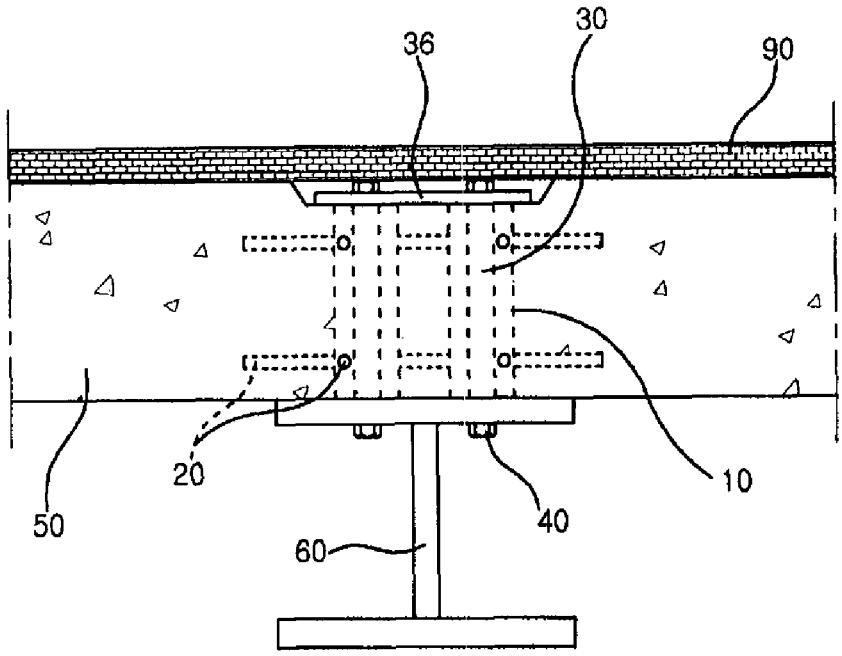
【Figure 5】
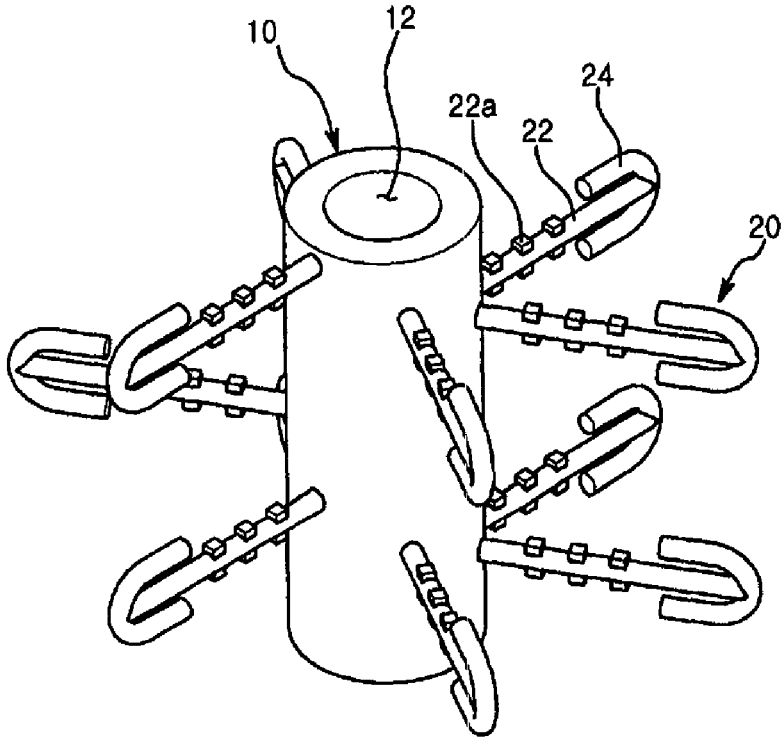

【Figure 6】
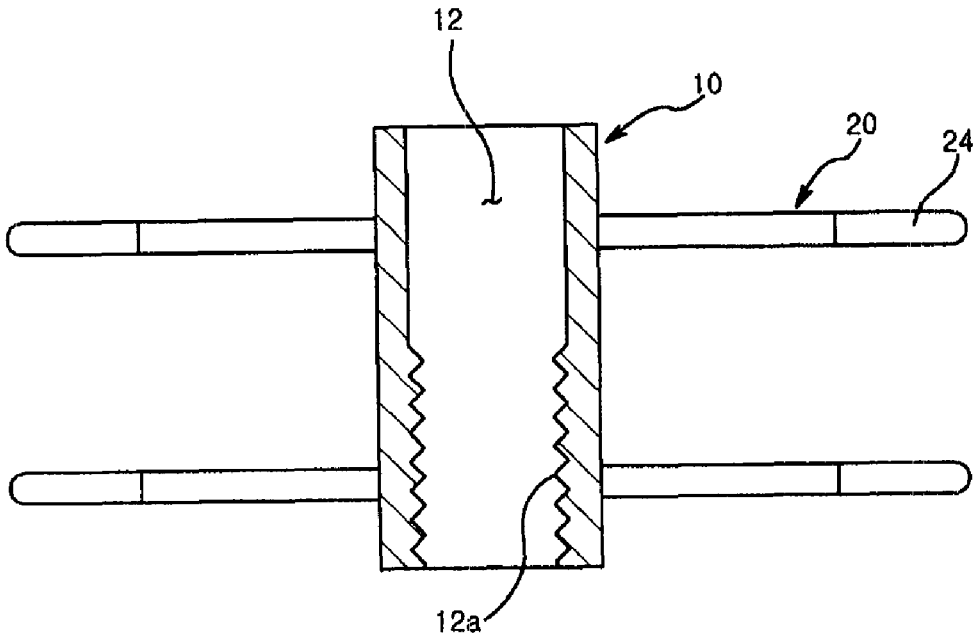
【Figure 7】
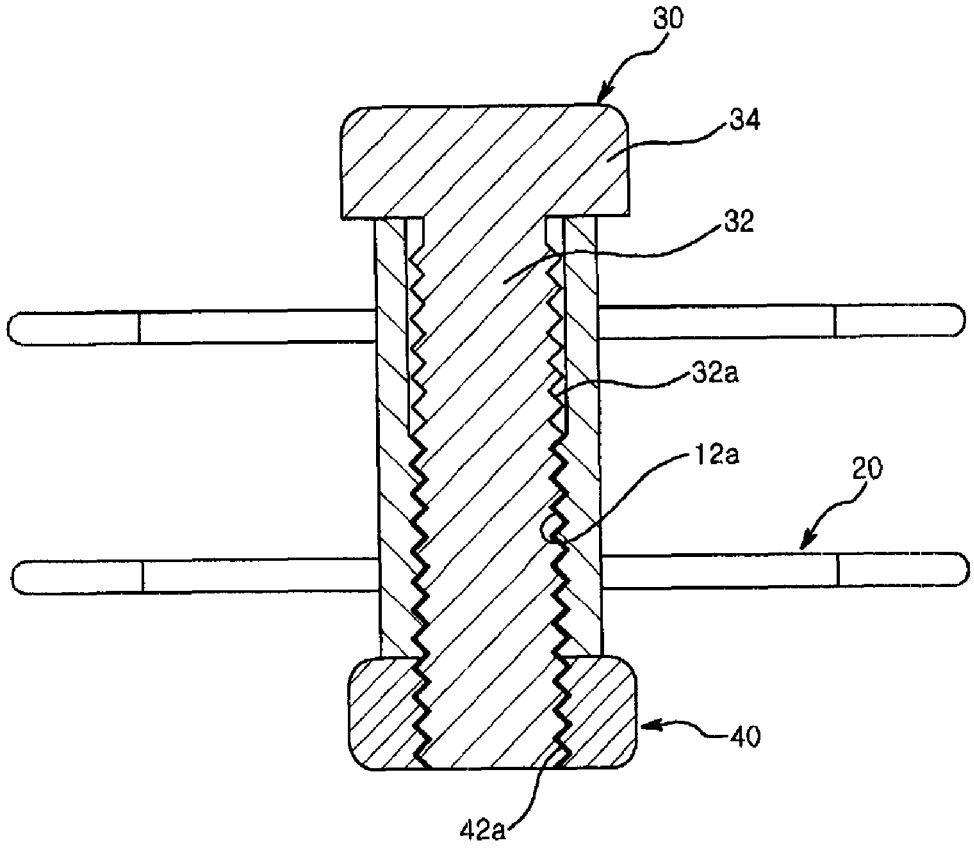

【Figure 8】
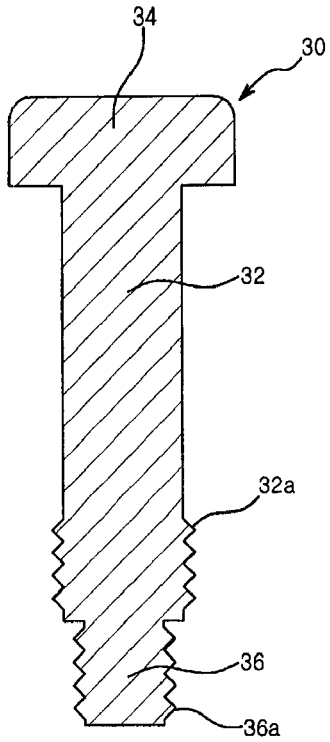
【Figure 9】
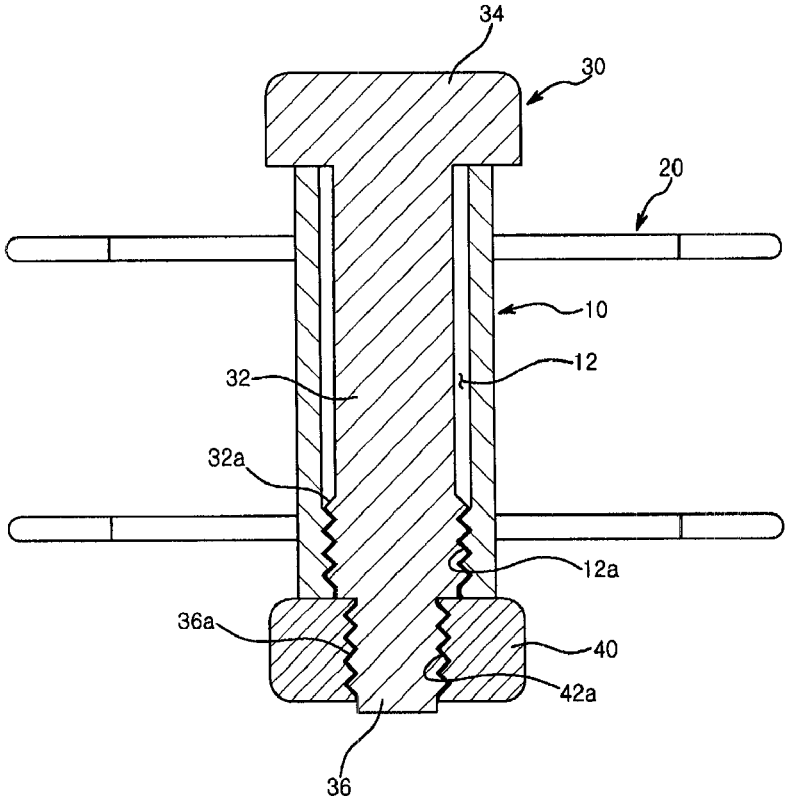

【Figure 10】
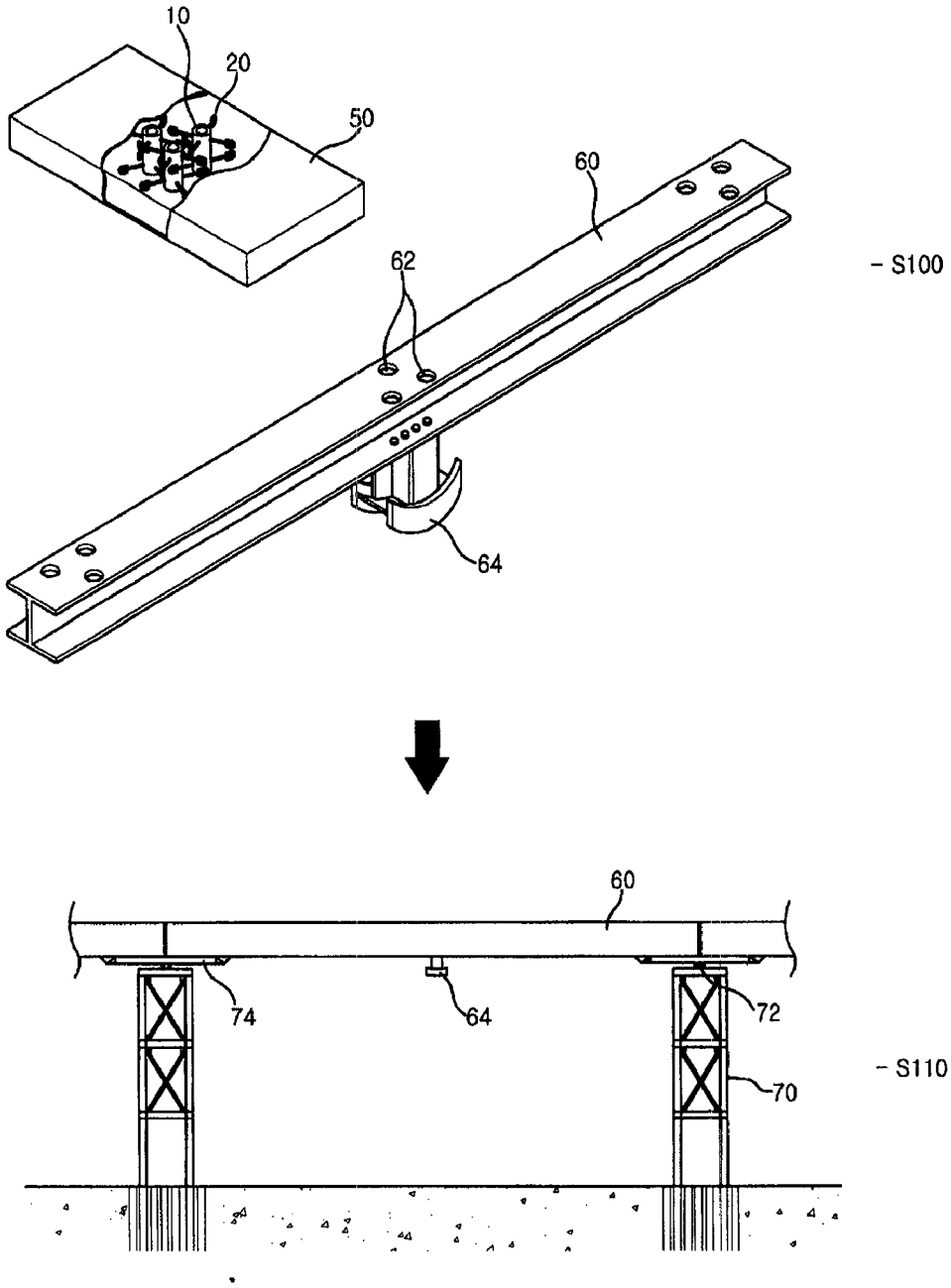

【Figure 11】
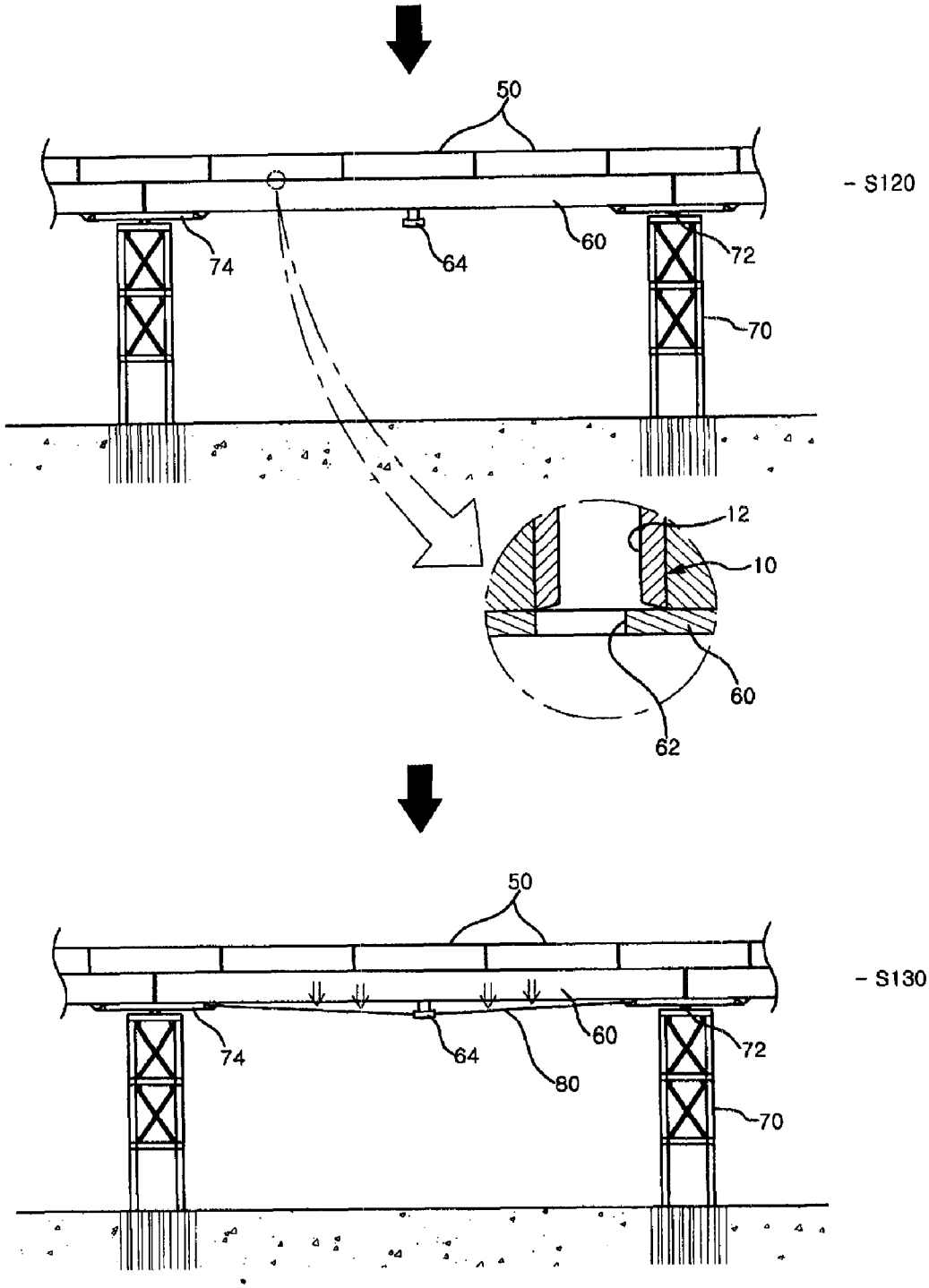

【Figure 12】
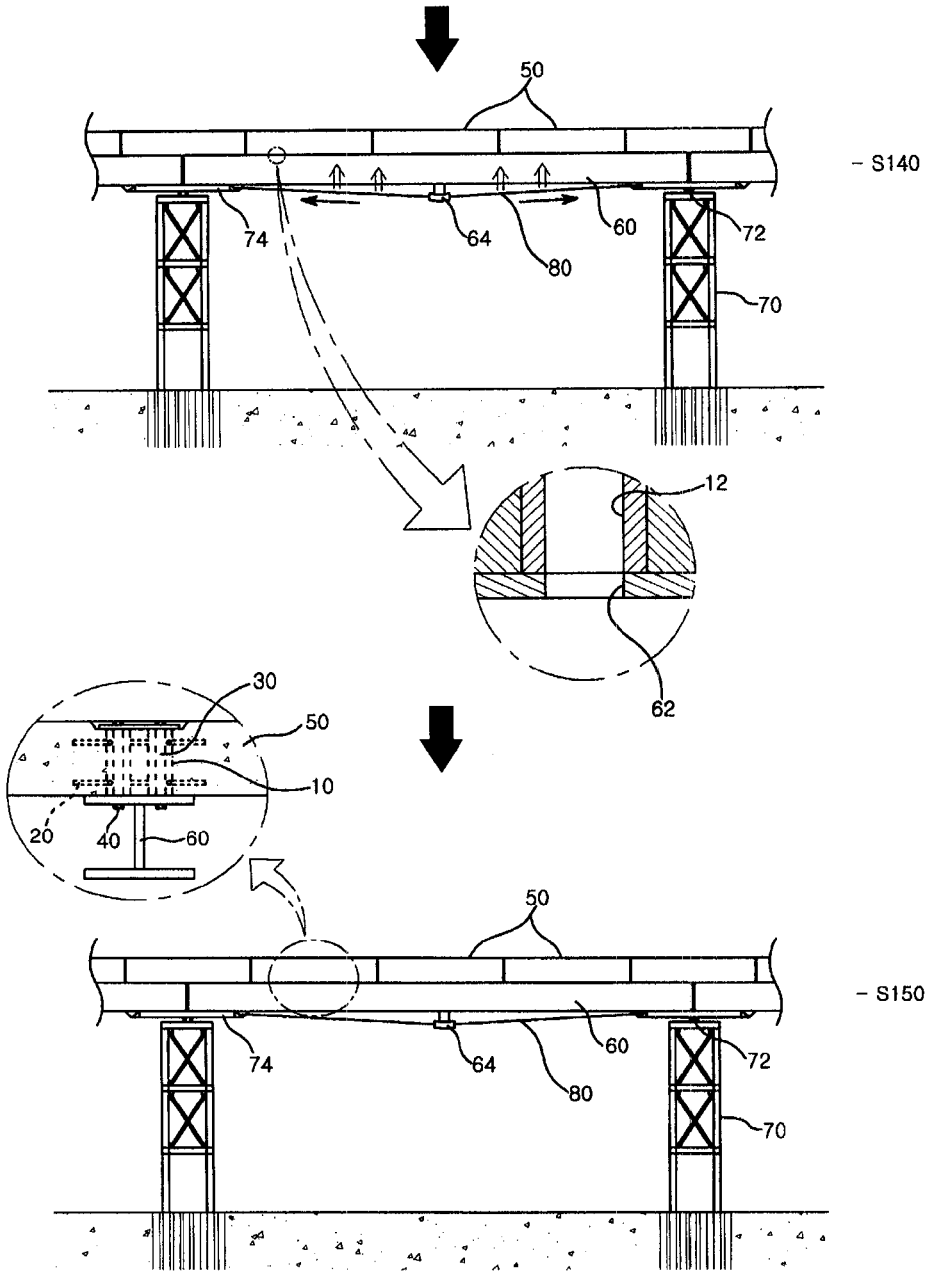

【Figure 13】
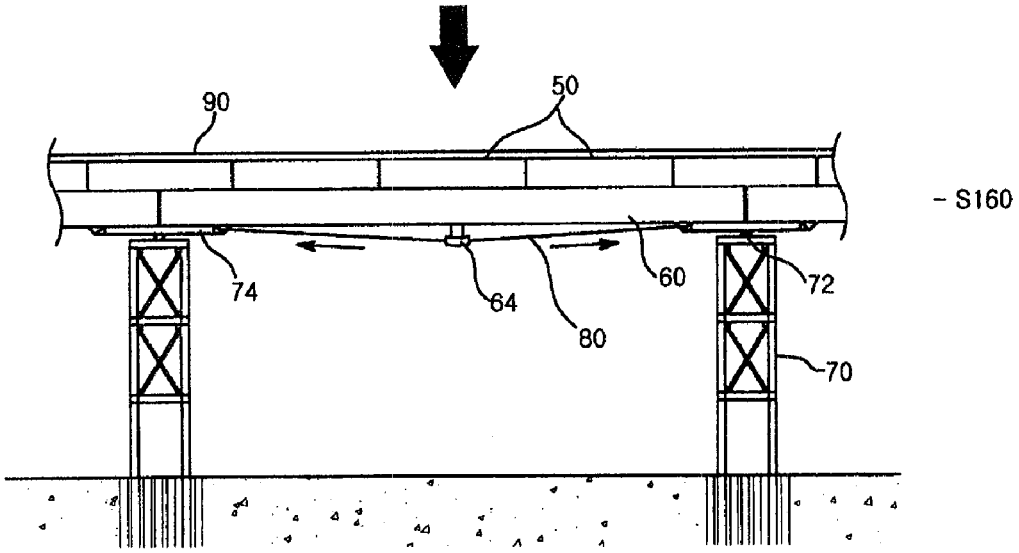
【Figure 14】
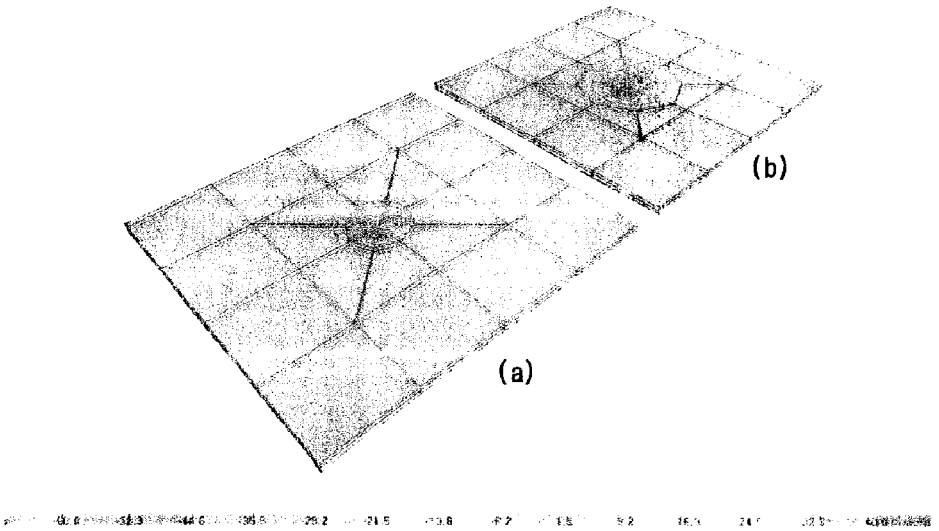

APPARATUS FOR CONNECTING A PRECAST DECK SLAB WITH A BEAM ON A BRIDGE AND METHOD FOR CONNECTING THE SLAB WITH THE BEAM USING THE SAME

TECHNICAL FIELD

The present invention relates to an apparatus for connecting a pre-cast deck slab with a beam on a bridge; more particularly, to an apparatus for connecting a pre-cast deck slab with a beam on a temporary bridge capable of precisely and securely connecting the pre-cast deck slab with the beam and preventing the connection part from being slackened due to live load after installing the bridge; and more particularly, to a method of connecting a pre-cast deck slab with a beam capable of rapidly, readily and stably connecting the pre-cast deck slab with the beam using the connection apparatus integrally buried in the pre-cast deck slab.

BACKGROUND ART

Generally, bridges are constructed and used for traffic between a position and another position, or other purposes. Meanwhile, in addition to the permanent bridges, a temporary bridge is temporarily or semi-permanently installed for traffic of construction vehicles, workers or passersby, or rapid installation of the bridge.

The temporary bridge is constructed by first connecting beams to each other or installing a temporary vent or a bridge post at the ground using concrete, connecting a plurality of bars or beams to an upper end of the temporary vent or the bridge post, and installing a deck plate or a pre-cast deck slab on the beam. In addition, the temporary bridge may be constructed by a method of introducing a pre-cast using a high-strength steel bar, and a method of continuously and repeatedly assembling trusses.

In the meantime, as shown in FIG. 1, the temporary bridge is constructed by disposing a pre-cast deck slab 3 formed of concrete on a plurality of beams 2 supported on an upper end of a bridge post 1, punching holes at the pre-cast deck slab 3 using a punching device, inserting bolts 4 into the holes, connecting the bolts 4 to the beam 2 and fastening nuts 5 to fix the pre-cast deck slab 3 to the beam 2, and applying a pavement material 6 such as mortar or asphalt concrete on the pre-cast deck slab 3 to thereby finish the installation of the bridge.

However, the conventional temporary bridge may cause several problems. That is, when the pre-cast deck slab formed of concrete is punched to connect the pre-cast deck slab with the beam, the deck slab is damaged due to impact. In addition, inconsistency between diameters of the holes and bolts cause gaps between the bolts and holes. These damages and gaps cause release of the bolts due to live load applied after installation of the bridge. Further, friction between the bolts and the concrete deck slab cause damage to the bridge to decrease safety of the bridge.

Further, in a conventional connection method between the beam and the pre-cast deck slab, since the pre-cast deck slab is punched using an additional tool to make operations complicated and unstable, it is impossible to rapidly and securely connect the pre-cast deck slab with the beam.

SUMMARY

In order to solve the foregoing and/or other problems, it is an aspect of the present invention to provide an apparatus for connecting a pre-cast deck slab with a beam on a bridge capable of stably, rapidly and securely connecting and fixing the pre-cast deck slab to the beam.

It is another aspect of the present invention to provide a method of connecting a pre-cast deck slab with a beam on a bridge capable of stably, rapidly and securely connecting and fixing the pre-cast deck slab to the beam using the connection apparatus integrally installed at the pre-cast deck slab.

The foregoing and/or other aspects of the present invention may be achieved by providing an apparatus for connecting a pre-cast deck slab with a beam including: a main body buried in the pre-cast deck slab and having a hollow part formed in an axial direction thereof; a plurality of support portions integrally formed with an outer surface of the main body, each of which has a body having a certain length and a hook integrally formed with an end of the body; a bolt having a bolt body inserted into the hollow part of the main body and a fixing hole of the beam, and a head integrally formed with an upper end of the bolt body; and a nut threadedly engaged with the bolt body.

The bolt body may have a thread and the hollow part of the main body may have a thread so that the bolt body is threadedly engaged with the hollow part.

The plurality of support portions may be spirally disposed on an outer surface of the main body in a reverse direction of the threaded direction formed at the bolt body, and the body of each support portion may have a plurality of projections.

The hollow part of the main body may have a thread formed at a portion of a lower end thereof.

The end of the bolt body may have a fastening part having a smaller diameter than the inner diameter of the hollow part and the outer diameter of the bolt body to pass through the hollow part of the main body, the fastening part may have a thread, the thread of the fastening part may be formed in a reverse direction of the thread of the bolt, and the thread formed at the hollow part of the nut may be detachably fastened to the thread of the fastening part.

Another aspect of the present invention may be achieved by providing a method of connecting a pre-cast deck slab with a beam including: pouring concrete on the connection apparatus disposed in a concrete form to form the pre-cast deck slab with the connection apparatus buried therein, punching a plurality of fixing holes at appropriate positions of the beam through which bolts are inserted, and installing a deflection member at a center lower part of the beam; moving the pre-cast deck slab and the beam to a construction site at which bridge posts are installed, and disposing both ends of the beam on two bridge posts; arranging a plurality of pre-cast deck slabs on the beams disposed on the bridge posts; fixing one end of a steel wire to one end of the beam and disposing a center part of the steel wire at a deflection member to fix the other end of the steel wire to the other end of the beam in a state that the pre-cast deck slab and the beam are disposed on the two posts, and maintaining the beam in a freely sagging state; primarily tensioning the steel wire using a pre-stressing means to align the hollow part of the main body with the fixing hole to horizontally maintain the beam when the beam disposed on the bridge posts at its both ends are sagged due to the weight of the beam and the weight of the pre-cast deck slab; inserting the bolt into the hollow part of the main body and the fixing hole of the beam when the hollow part of the main body is aligned with the fixing hole of the beam, and fastening a nut to the bolt from the beam to connect and fix the pre-cast deck slat) with the beam; and secondarily tensioning the steel wire to correspond to a rated live load of moving means passing through the deck slab when the pre—cast deck slab is connected to the beam.

In accordance with an apparatus for connecting a pre-cast deck slab with a beam and a method of connecting a pre-cast deck slab with a beam using the same of the present invention, it is possible to connect the pre-cast deck slab with the beam using bolts and nuts in a state that a main body having a support part is buried in the pre-cast deck slab and integrated therewith before installation of a bridge, and rapidly and securely connecting and fixing the pre-cast deck slab to the beam to increase stability.

Further, since there is no necessity of punching holes for inserting bolts into the pre-cast deck slab, it is possible to prevent damage to the pre-cast deck slab. Furthermore, release of the bolts and damage to the pre-cast deck slab due to live load after installation of the bridge can be prevented to improve reliability.

In addition, the pre-cast deck slab can be rapidly and securely connected and fixed to the beam using the connection apparatus integrated with the pre-cast deck slab to improve operation performance.

BRIEF DESCRIPTION OF THE DRAWINGS

The above and other aspects and advantages of the present invention will become apparent and more readily appreciated from the following description of exemplary embodiments, taken in conjunction with the accompanying drawings of which:

FIG. 1 is a schematic view showing conventional connection between a pre-cast deck slab and a beam of a bridge;

FIG. 2 is an exploded perspective view showing an apparatus for connecting a pre-cast deck slab with a beam of a bridge in accordance with a first exemplary embodiment of the present invention;

FIG. 3 is an enlarged cross-sectional view of a main body of the connection apparatus of FIG. 2 buried in the pre-cast deck slab;

FIG. 4 is an enlarged cross-sectional view showing the pre-cast deck slab connected with the beam by the connection apparatus of FIG. 2;

FIG. 5 is a perspective view showing a main body of the connection apparatus in accordance with a second exemplary embodiment of the present invention;

FIG. 6 is a longitudinal cross-sectional view showing the interior of a main body of a connection apparatus in accordance with a third exemplary embodiment of the present invention;

FIG. 7 is a cross-sectional view of a bolt and a nut engaged with the main body of the connection apparatus of FIG. 6;

FIG. 8 is a longitudinal cross-sectional view showing structure of a bolt of a connection apparatus in accordance with a fourth exemplary embodiment of the present invention;

FIG. 9 is a cross-sectional view of a main body and a nut engaged with a bolt of the connection apparatus of FIG. 8;

FIGS. 10 to 13 are process views showing a method of connecting a pre-cast deck slab with a beam using a connection apparatus in accordance with an exemplary embodiment of the present invention; and FIG. 14*a* is a view showing stress distribution generated by a conventional bolt connection type of FIG. 1, and FIG. 14*b* is a view showing stress distribution generated by a connection apparatus in accordance with the present invention.

DETAILED DESCRIPTION

Herein after, the embodiments of the present invention will be described in detail with reference to the accompanying drawings.

Referring to FIGS. 2 to 4, an apparatus for connecting a pre-cast deck slab with a beam on a temporary bridge in accordance with the present invention includes a main body 10, wherein the main body 10 can be formed n a space of a cavity, a hollow cylinder or a cylinder.

As shown in FIG. 3, the main body 10 may be integrally formed in the pre-cast deck slab by be buried in a pre-cast deck slab 50. That is, after disposing the main body 10 at a predetermined position in a concrete form (not shown) before pouring concrete during a process of forming the pre-cast deck slab, the concrete is poured such that the main body 10 can be buried in the pre-cast deck slab 50.

And also, in the main body 10, a hollow part 12 is formed to insert a bolt 30 therethrough. The hollow part 12 passes in an axial direction of the main body 10.

A plurality of support portions 20 are installed at an outer surface of the main body 10, and are buried in the pre-cast deck slab 50 together with the main body 10. It is preferable that each support portion 20 is integrally formed with the outer surface of the main body 10, and is formed in a direction perpendicular to the axial direction of the main body 10.

Each support portion 20 includes a body 22 integrally formed with the main body 10 and having a predetermined length, and a hook part 24 integrally formed with an end of the body 22. The hook part 24 increases a contact area with the pre-cast deck slab 50 formed of concrete to securely support the main body 10.

In addition, each support portion 20 may be formed at the outer surface of the main body 10 in various manners. For example, as shown in FIG. 3, the plurality of support portions 20 may be disposed at upper and lower parts of the main body 10 in a circumferential direction thereof, or may be disposed in plural rows according to the thickness of the pre-cast deck slab 50.

Further, the present invention includes the bolt 30 to be inserted into the hollow part 12 of the main body 10 and the bolt 30 securely connects and fixes the pre-cast deck slab 50 to a beam 60 substantially. The bolt 30 basically includes a bolt body 32 passing through the hollow part 12 of the main body 10 and having a thread 32*a* threadedly engaged with a nut 40, and a head 34 integrally formed with an upper end of the bolt body 32. In an actual engagement, as shown in FIG. 4, the bolt body 32 of the bolt 30 is inserted into the hollow part 12 of the main body 10 to be inserted into a fixing hole 62 (see FIG. 12) of the beam 60 and then fastened by the nut 40, thereby connecting and fixing the pre-cast deck slab 50 to the beam 60. Of course, it is preferable that a washer 36 is used upon engagement of the bolt 30.

The nut 40 is detachably fastened to an end of the bolt body 32 of the bolt 30 to fix the bolt 30 with the pre-cast deck slab 50 and the beam 60. A hollow part 42 having a diameter corresponding to the diameter of the bolt body 32 of the bolt 30 is formed at a center of the nut 40, and a thread 42*a* threadedly engaged with the thread 32*a* formed at the bolt body 32 of the bolt 30 is formed at the hollow part 42.

Meanwhile, as shown in FIG. 5, in accordance with a second embodiment of the present invention, the support portions 20 may be disposed at the main body 10 in various manners. For example, the support portions 20 may be arranged in a spiral pattern. Spiral arrangement of the support portions 20 is formed in a reverse direction of the thread 32*a* formed at the bolt body 32 of the bolt 30 from an upper part to a lower part thereof. This is in order to prevent the main body 10 from being moved or loosening due to a fastening force applied to the bolt 30 when the bolt 30 is fastened. In addition, the body 22 of each support portion 20 may have a plurality of projections 22*a* projecting from the body 22 to increase a contact area between the body 22 or the support portion 20 and the pre-cast deck slab 50.

Further, as shown in FIGS. 6 and 7, in accordance with a third exemplary embodiments of the present invention, in order to more securely couple the main body 10 to the bolt 30 and the nut 40 and more securely connect and fix the pre-cast deck slab 50 to the beam 60, a thread 12*a* detachably engaged with the thread 32*a* formed at the bolt body 32 of the bolt 30 is formed at an inner surface of the hollow part 12 of the main body 10.

Selectively, as shown in FIGS. 8 and 9 in accordance with a fourth exemplary embodiment of the present invention, the thread 12*a* is formed at only a portion of a lower end of the hollow part 12 of the main body 10. Therefore, the thread 32*a* detachably engaged with the thread 12*a* formed at the hollow part 12 of the main body 10 is formed at the bolt body 32 of the bolt 30.

In particular, a fastening part 36 having a smaller diameter than an inner diameter of the hollow part 12 and an outer diameter of the bolt body 32 is formed at an end of the bolt body 32 of the bolt 30 to freely pass through the hollow part 12 of the main body 10. It is preferable that the fastening part 36 has a thread 36*a* formed in a reverse direction of the thread 32 formed at the bolt body 32 of the bolt 30. As described above, the reason for differently forming the direction of the thread 32*a* of the bolt body 32 of the bolt 30 from the direction of the thread 36*a* of the fastening part 36 is in order to prevent release of the bolt by fastening the bolt when live load after installation of a bridge is applied to the bolt 30 to cause the bolt 30 to be rotated in a release direction.

Of course, when the fastening part 36 is formed at the bolt 30, a diameter of the hollow part 42 of the nut 40 must correspond to a diameter of the fastening part 36 of a bolt 30, and the thread 42*a* formed at the hollow part 42 should be detachably fastened to the thread 36*a* formed at the fastening part 36 of the bolt 30.

Hereinafter, a method of connecting a pre-cast deck slab with a beam using the connection apparatus as described above will be described with reference to FIGS. 10 to 14 and FIGS. 2 to 9

First, an operator disposes the connection apparatus of the present invention on an appropriate position of a concrete form (not shown), and then, pours concrete to form a pre-cast deck slab 50 with the connection apparatus buried therein. In addition, a fixing hole 62 through which a bolt 30 is inserted is punched at an appropriate position of a beam 60, and a deflection member 64 is installed at a center lower part of the beam 60 (S100 of FIG. 10).

As described above, after the pre-cast deck slab 50 and the beam 60 are moved to a construction site, at which bridge posts 70 are installed, both ends of the beam 60 are disposed on the two bridge posts 70 (S110 of FIG. 10). Here, when the beam 60 is actually installed or disposed on the bridge posts 70, a fixing member 72 formed of a beam or a bar is disposed on upper ends of the bridge posts 70, and the beam 60 is installed in a manner that a built-up beam 74 fixed to a lower part of the beam 60 is disposed on the fixing member 72. Since the above installation method is widely known, its detailed description will be omitted.

In addition, the plurality of pre-cast deck slabs 50 are arranged and disposed on the beam 60 disposed on the bridge posts 70 (S120 of FIG. 11). Here, the connection apparatus installed at each pre-cast deck slab 50 may be disposed such that the hollow part 12 of the main body 10 is approximately aligned with the fixing hole 62 punched at the beam 60 or disposed adjacent to the fixing hole 62.

In a state that the pre-cast deck slab 50 and the beam 60 are disposed on the two bridge posts 70, an operator fixes one end of a steel wire 80 to one end of the beam 60, after disposing a center part of the steel wire 80 at a deflection member 64, fixes the other end of the steel wire 80 to the other end of the beam 60 or a support beam, and maintains the beam 60 in a free sagging state (S130 of FIG. 11). In actual installation of the steel wire 80, both ends of the steel wire 80 are fixed to both ends of the built-up beam 74 under the beam 60 disposed on the bridge posts 70.

When the beam 60 disposed on the two bridge posts 70 at both ends of the beam 60 is sagged due to the weight of the beam 60 and the weight of the pre-cast deck slab 50, one end or both ends of the steel wire 80 are tensioned to horizontally maintain the beam 60 using a pre-stressing means (not shown) to align the hollow part 12 of the main body 10 with the fixing hole 62 of the beam 60 (S140 of FIG. 12).

As described above, when the hollow part 12 of the main body 10 is aligned with the fixing hole 62 of the beam 60 by tensioning and horizontally maintaining the beam 60, after inserting the bolt 30 into the hollow part 12 of the main body 10 and the fixing hole 62 of the beam 60, the nut 40 is fastened to the bolt body 32 of the bolt 30 or the fastening part 36 from the beam 60 to connect and fix the pre-cast deck slab 50 to the beam 60 (S150 of FIG. 12). Here, the thread 42*a* of the nut 40 is engaged with the thread 32*a* of the bolt 30 to connect and fix the pre-cast deck slab 50 to the beam 60. At this time, the support portions 20 of the main body 10 are integrally formed with the concrete forming the pre-cast deck slab 50 to prevent shaking or movement of the main body 10. In particular, as shown in FIG. 5, when the support portions 20 are spirally disposed at the main body 10 or a plurality of projections 22*a* project from the body 22, the main body 10 can be securely maintained.

Meanwhile, as shown in FIGS. 6 and 7, when the thread 12*a* detachably engaged with the thread 32*a* formed at the bolt body 32 of the bolt 30 is formed at an inner surface of the hollow part 12 of the main body 10, the bolt 30 is directly fastened to the main body 10 and fastened to the nut 40 to more stably and securely fix them to each other.

In particular, as shown in FIGS. 8 and 9, when the thread 12*a* is formed all a lower end of the hollow part 12 of the main body 10 and the fastening part 36 having the thread 36*a* is integrally formed with a lower end of the bolt body 32 of the bolt 30, since the direction of the thread 32*a* of the bolt body 32 of the bolt 30 is different from the direction of the thread 36*a* of the fastening part 36, though live load by a moving body after installation of the bridge is applied to the bolt 30, it is possible to prevent the bolt 30 from being rotated in a release direction and to securely fasten or fix the pre-cast deck slab 50 to the beam 60.

Finally, when the pre-cast deck slab 50 is connected with the beam 60, the steel wire 80 is secondarily tensioned to correspond to a rated live load of moving means passing over the deck slab (S160 of FIG. 13). Then, in order to complete the bridge, in a state that the beam 70 and the pre-cast deck slab 50 are perfectly connected and fixed to the bridge posts 70, a pavement material 90 such as asphalt or mortar is applied on the pre-cast deck slab 50 to complete the bridge.

After installation of the bridge, even though the live load due to vehicles or passersby is applied to the pre-cast deck slab 50 and the bolts 30, it is possible to securely fasten the bolt 30 by the main body 10 and the nut 40 and to prevent the bolts 30 from being released or loosening.

As shown in FIG. 14, stress distribution generated in a connection state of a conventional bolt connection method and stress distribution generated in a connection state of a method of connecting a pre-cast deck slab with a beam in accordance with the present invention are shown.

Here, the bolt used in the conventional bolt connection method has the same diameter as the bolt 30 in accordance with the present invention, and a ratio of the diameters of the bolt 30 and the main body 10 is 1:2. In this condition, when the same horizontal load (bridge axial load) of about 50 kgf/cm$^2$ is applied, tensile stresses of ambient concrete through finite element analysis are shown in the following table 1.

TABLE 1

Comparison of concrete generation tensile stresses for arbitrary horizontal load

| Classification | Conventional simple bolt | Connection apparatus in accordance with the present invention |
|---|---|---|
| Concrete generation stress | 37.6 kgf/cm$^2$ | 10.9 kgf/cm$^2$ |
| Comparison | 3.4 | 1.0 |

According to Table 1, while the connection apparatus including the cylindrical main body 10 integrally formed with the plurality of support portions 20 and the bolt 30 had the concrete generation stress of 10.9 kgf/cm$^2$, the conventional bolt connection method had stress of 37.6 kgf/cm$^2$. Eventually, a ratio of tensile stresses applied to the concrete was shown as 1:3.4.

When the connection method using the connection apparatus in accordance with the present invention is used, rather than the conventional bolt connection method, since it is possible to reduce the stress generated in the concrete more than three times when the pre-cast deck slab is connected with the beam, it is possible to stably connect the deck slab with the beam and stably maintain the entire bridge.

Therefore, in a steel frame bridge, the pre-cast deck slab can be stably fixed to the beam, and the pre-cast deck slab can be rapidly, readily and stably connected with the beam.

The present application contains subject matter related to Korean patent application NO. 10-2006-0115853, filed in the Korean Patent Office on Nov. 22, 2006. the entire contents of which being incorporated herein by reference.

The forgoing description concerns in exemplary embodiment of the invention, is intended to be illustrative, and should not be construed as limiting the invention. The present teachings can be readily applied to other types of devices and apparatuses. Many alternatives, modifications, and variations within the scope and spirit of the present invention will be apparent to those skilled in the art.

The invention claimed is:

1. An apparatus for connecting a pre-cast deck slab formed of concrete with a beam disposed between at least two bridge posts, comprising:

a main body buried in the pre-cast deck slab and provided with a hollow part formed in an axial direction thereof;

a plurality of support portions integrally formed on an outer surface of the main body, each of which includes a body with a predetermined length and a hook integrally formed on an end of the body;

a bolt provided with a bolt body inserted into the hollow part of the main body and a fixing hole of the beam, and a head integrally formed on an upper end of the bolt body; and a nut threadedly and separably engaged with the bolt body of the bolt.

2. The apparatus for connecting a pre-cast deck slab with a beam according to claim 1, wherein a thread is formed on the bolt body and a thread is formed on the hollow part of the main body so that the bolt body is threadedly engaged with the hollow part.

3. The apparatus for connecting a pre-cast deck slab with a beam according to claim 1, wherein the plurality of support portions are spirally disposed on an outer surface of the main body in a reverse direction of the threaded direction formed at the bolt body, and a plurality of projections are protrusively formed on the body of each support portion.

4. The apparatus for connecting a pre-cast deck slab with a beam according to claim 1, wherein a thread is formed at a portion of a lower end in the hollow part of the main body.

5. The apparatus for connecting a pre-cast deck slab with a beam according to claim 4, wherein a fastening part having a smaller diameter than the inner diameter of the hollow part and the outer diameter of the bolt body is formed in the end of the bolt body to pass through the hollow part of the main body, a thread is formed on the fastening part, the thread of the fastening part is formed in a reverse direction of the thread of the bolt, and the thread formed at the hollow part of the nut is separably connected to the thread of the fastening part.

6. A method of connecting a pre-cast deck slab with a beam on at least two bridge posts using the connection apparatus according to claim 1, comprising:

pouring concrete on the connection apparatus disposed in a concrete form to form the pre-cast deck slab with the connection apparatus buried therein, punching a plurality of fixing holes at appropriate positions of the beam through which bolts are inserted, and installing a deflection member at a center lower part of the beam;

moving the pre-cast deck slab and the beam to a construction site at which bridge posts are installed, and disposing both ends of the beam on two bridge posts;

arranging a plurality of pre-cast deck slabs on the beams disposed on the bridge posts;

fixing one end of a steel wire to one end of the beam and disposing a center part of the steel wire at a deflection member to fix the other end of the steel wire to the other end of the beam in a state that the pre-cast deck slab and the beam are disposed on the two posts, and maintaining the beam in a freely sagging state after fixing the other end of the steel wire to the other end of the beam;

primarily tensioning the steel wire using a pre-stressing means to align the hollow part of the main body with the fixing hole to horizontally maintain the beam when the beam disposed on the bridge posts at both ends thereof are sagged due to the weight of the beam and the weight of the pre-cast deck slab;

inserting the bolts into the hollow part of the main body and the fixing hole of the beam when the hollow part of the main body is aligned with the fixing hole of the beam, and fastening a nut to the bolt from the beam to connect and fix the pre-cast deck slab with the beam; and secondarily tensioning the steel wire to correspond to a rated live load of moving means passing through the deck slab when the pre-cast deck slab is connected to the beam.

7. The apparatus for connecting a pre-cast deck slab with a beam according to claim 4, wherein the hollow part formed in the axial direction of the main body is sealed in a radial direction against the concrete of the pre-cast deck slab.

* * * * *

UNITED STATES PATENT AND TRADEMARK OFFICE

CERTIFICATE OF CORRECTION

PATENT NO. : 7,874,035 B2
APPLICATION NO. : 12/297981
DATED : January 25, 2011
INVENTOR(S) : Sun-Kyu Park et al.

It is certified that error appears in the above-identified patent and that said Letters Patent is hereby corrected as shown below:

Col. 2, Line 64
Delete "slat"
Insert --slab--

Col. 6, Line 42
Delete "all"
Insert --at--

Col. 7, Line 44
Delete "in"
Insert --an--

Signed and Sealed this
Eleventh Day of October, 2011

David J. Kappos

David J. Kappos
*Director of the United States Patent and Trademark Office*